US006991019B2

(12) United States Patent
Chang

(10) Patent No.: US 6,991,019 B2
(45) Date of Patent: Jan. 31, 2006

(54) SCREEN

(76) Inventor: Wei Chi Chang, P.O. Box 26-757, Taipei (TW), 106

( * ) Notice: Subject to any disclaimer, the term of this patent is extended or adjusted under 35 U.S.C. 154(b) by 128 days.

(21) Appl. No.: 10/638,255

(22) Filed: Aug. 6, 2003

(65) Prior Publication Data

US 2005/0028943 A1 Feb. 10, 2005

(51) Int. Cl.
*A47H 1/00* (2006.01)

(52) U.S. Cl. ..... 160/24; 160/313; 160/323.1

(58) Field of Classification Search ..... 160/23.1, 160/24, 318, 313, 323.1
See application file for complete search history.

(56) References Cited

U.S. PATENT DOCUMENTS 1,443,695 A * 1/1923 McKibbin ..... 160/24
1,729,133 A * 9/1929 Shonnard ..... 160/313
2,364,695 A * 12/1944 Coleman ..... 160/25
2,530,877 A * 11/1950 Heck et al. ..... 160/24
3,763,916 A * 10/1973 Gossling ..... 160/318
5,172,745 A * 12/1992 Wang ..... 160/370.22
5,647,421 A * 7/1997 Hoffmann et al. ..... 160/120
6,115,951 A * 9/2000 Jing et al. ..... 40/610

FOREIGN PATENT DOCUMENTS

TW 89215501 6/2001

* cited by examiner

*Primary Examiner*—Blair M. Johnson
(74) *Attorney, Agent, or Firm*—Rosenberg, Klein & Lee

(57) ABSTRACT

A screen is constructed to have a screen case, a support member fastened to one side of the screen case and a reel pivotally mounted inside the screen case and rolling up a screen body. The reel has a flat inside stop face and a plug member is fixedly fastened to one end of the reel. An axle is suspended inside the reel, the axle having a first end fixedly fastened to the screen case and a second end fastened pivotally with the plug member. A spring member is sleeved onto the axle inside the reel, the spring member having a first end terminating in a projecting portion stopped at the flat inside stop face of the reel and a second end fixedly connected to one end of the axle.

13 Claims, 5 Drawing Sheets

SCREEN

BACKGROUND OF THE INVENTION

1. Field of the Invention

The present invention relates to a screen and, more particularly to a screen comprising a support supporting a screen case on a flat floor surface and a reel fastened pivotally to the inside of the screen case and rolling up a screen body. The screen is used as an advertising medium and further comprises a bracket located on the top end of the support and adapted to hold the slat at the end of the screen body outside the screen case, and a spring member adapted to reverse the reel after release of the screen body from the pulling force. The spring member is quickly installed when inserted into the reel. Further, the reel can be made subject to the desired length without changing the design of the spring member.

2. Description of the Related Art

Taiwan Patent No. 89215501 discloses a screen design with numerous drawbacks outlined as follows:

1. The two ends of the spring member 16 must be respectively hooked in a small hook hole in the end cap 15 and a small hook hole in a fixed part of the reel 13. The inconvenient installation procedure of the spring member 16 complicates the fabrication of the screen, and relatively increases the manufacturing cost of the screen.

2. When a different length of reel 14 is used, the internal axle 13 and spring member 16 must be changed accordingly. Because the axle 13 and the reel 14 must be the same in length, changing the length of the reel 14 must change the length of the axle 13. When the length of the axle 13 changed, the hooking position of the spring member 16 is also changed. Therefore, it is complicated to change the size of the reel 14.

3. The screen is unstable when placed on the floor. Because the bottom end of the telescopic tube 22 of the screen 18 is plugged into a holder base 21, which is suspended above the floor on which the screen 18 stands (see FIG. 3 of the prior art specification), the screen 18 may fall to the floor easily.

SUMMARY OF THE INVENTION

The present invention has been accomplished under the circumstances in view. It is the main object of the present invention to provide a screen that is easy to install. It is another object of the present invention to provide a screen that is inexpensive to manufacture. It is still another object of the present invention to provide a screen that enables the user to change the length of the reel without changing the arrangement of the spring member and the other parts of the screen. It is still another object of the present invention to provide a screen that stands firmly on the floor.

To achieve these and other objects of the present invention, the screen comprises a screen case with a support member fastened to one side of the screen case. A reel shaped like a split tube is pivotally mounted inside the screen case and rolls up the screen, the reel having a longitudinally extended flat inside stop face. A plug member is fixedly fastened to one end of the reel. An axle is suspended inside the reel, the axle having first end fixedly fastened to the screen case and a second end fastened pivotally to the plug member. A spring member is sleeved onto the axle inside the reel, the spring member having a first end terminating in a projecting portion stopped at the flat inside stop face of the reel and a second end fixedly connected to one end of the axle. When the screen body is pulled out, the reel is rotated on the axle in one direction to further twist the spring member. When the pulling force on the screen body is released, the spring member imparts a biasing force to rotate the reel on the axle in the reversed direction and roll up the screen body.

DETAILED DESCRIPTION OF THE PREFERRED EMBODIMENT

Figure 1:
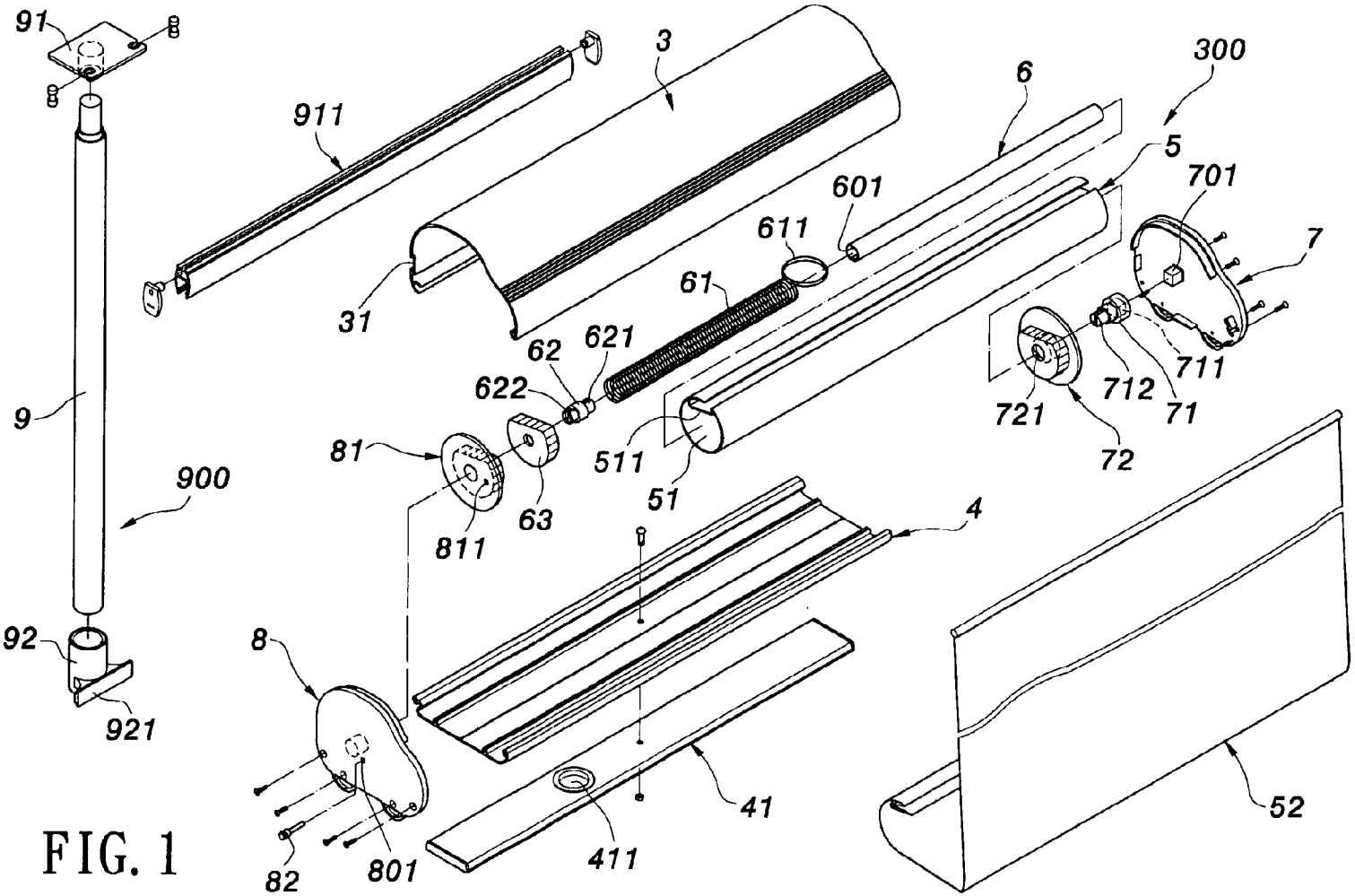
FIG. 1 is an exploded view of a screen according to the present invention.
Figure 2:
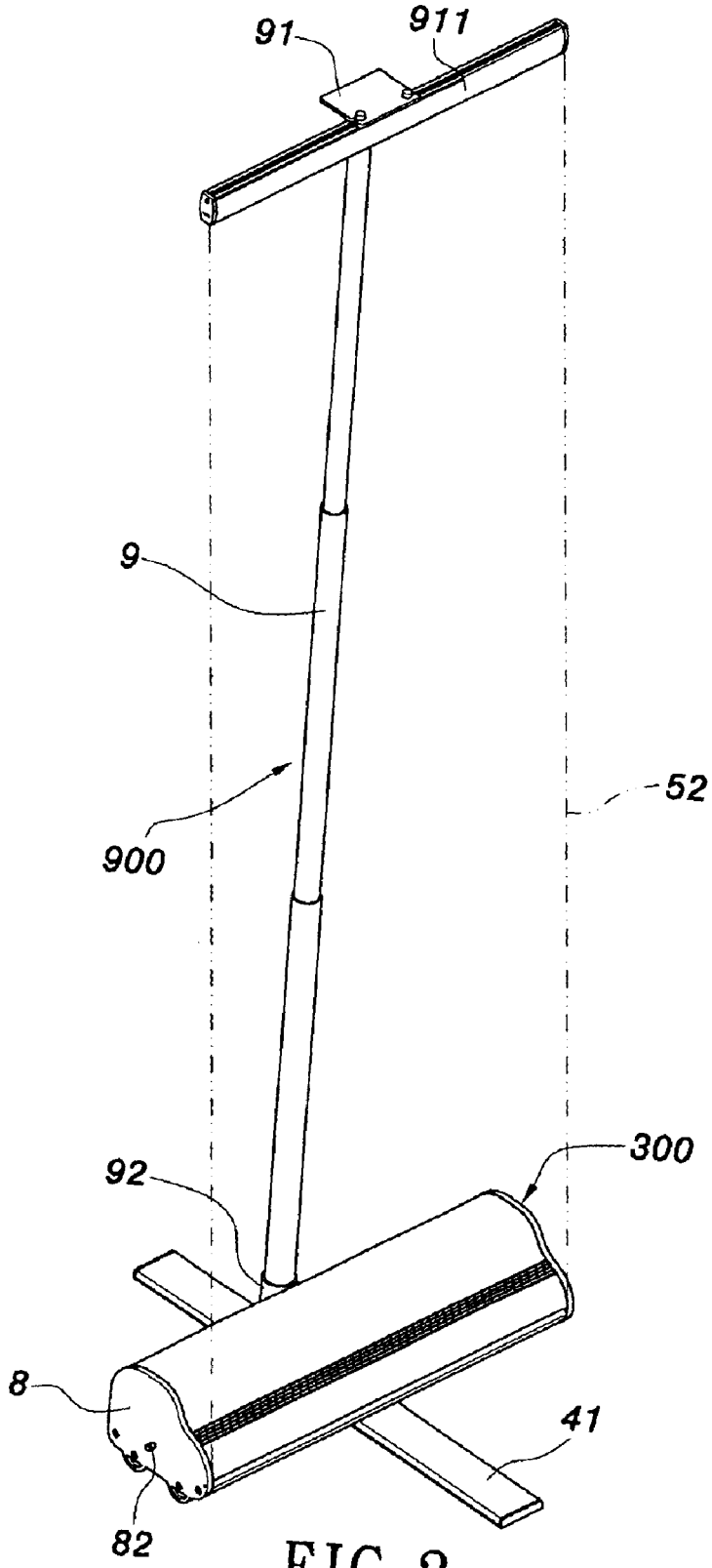
FIG. 2 is a perspective assembly view of the screen according to the present invention.

Referring to FIGS. 1 and 2, a screen in accordance with the present invention is shown comprised of a screen case 300, and a screen support 900. The screen case 300 comprises a bottom cover shell 4, a top cover shell 3 covering the bottom cover shell 4 at the top, and two end caps, namely, the first end cap 7 and the second end cap 8 respectively fastened to the ends of the cover shells 3 and 4. A reel 5 is mounted inside the screen case 300 and pivotally connected between the end caps 7 and 8, rolling up a screen body 52. The screen support 900 is fastened to the screen case 300 at one side, and adapted to support the screen body 52 in an extended position.

The first end cap 7 has a non-circular peg 701 in the inner side thereof. The second end cap 8 has a round peg. Further, a tubular axle 6 is provided inside the reel 5 between the end caps 7 and 8.

Figure 3:
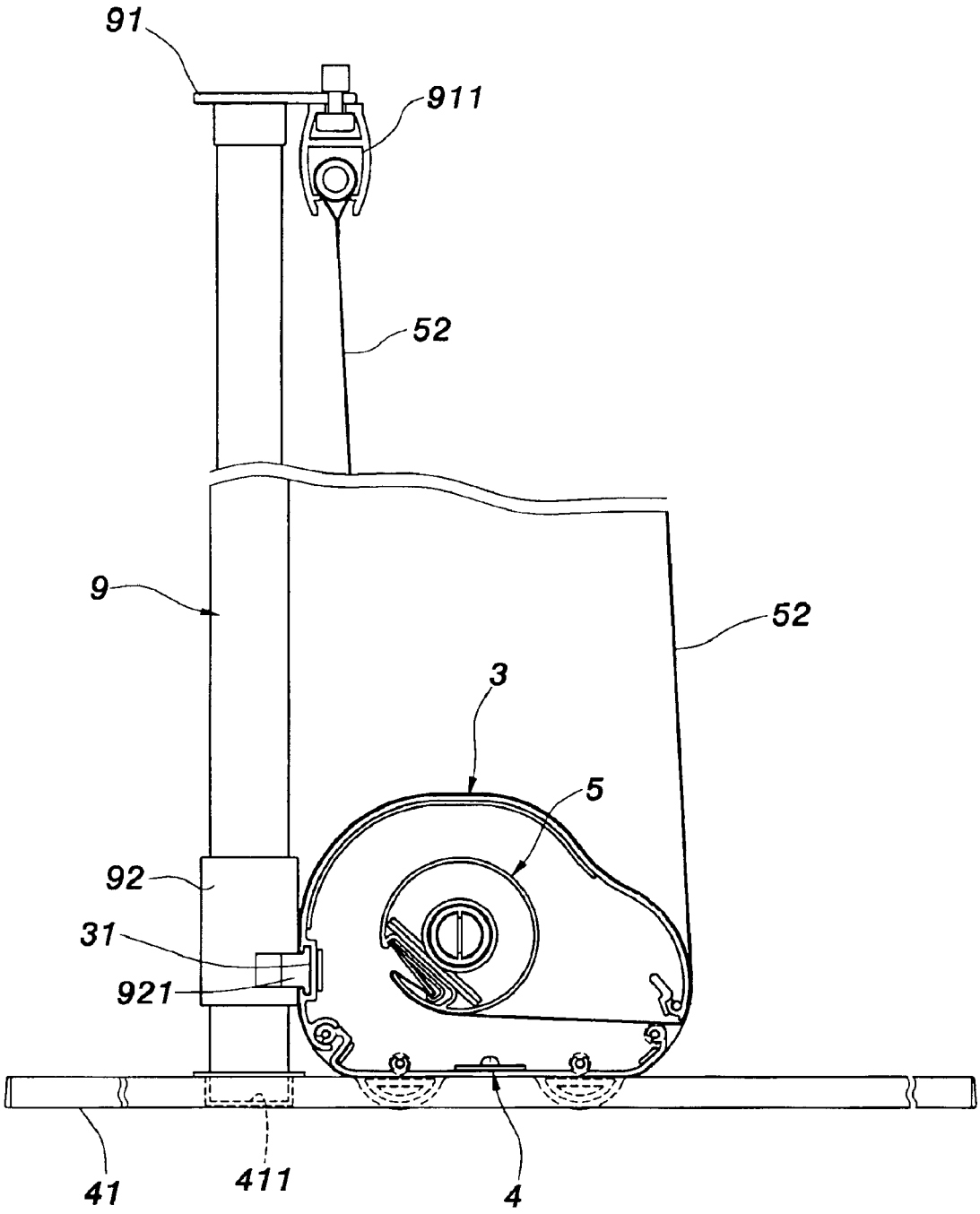
FIG. 3 is a schematic side view in an enlarged scale of FIG. 2.
Figure 3A:
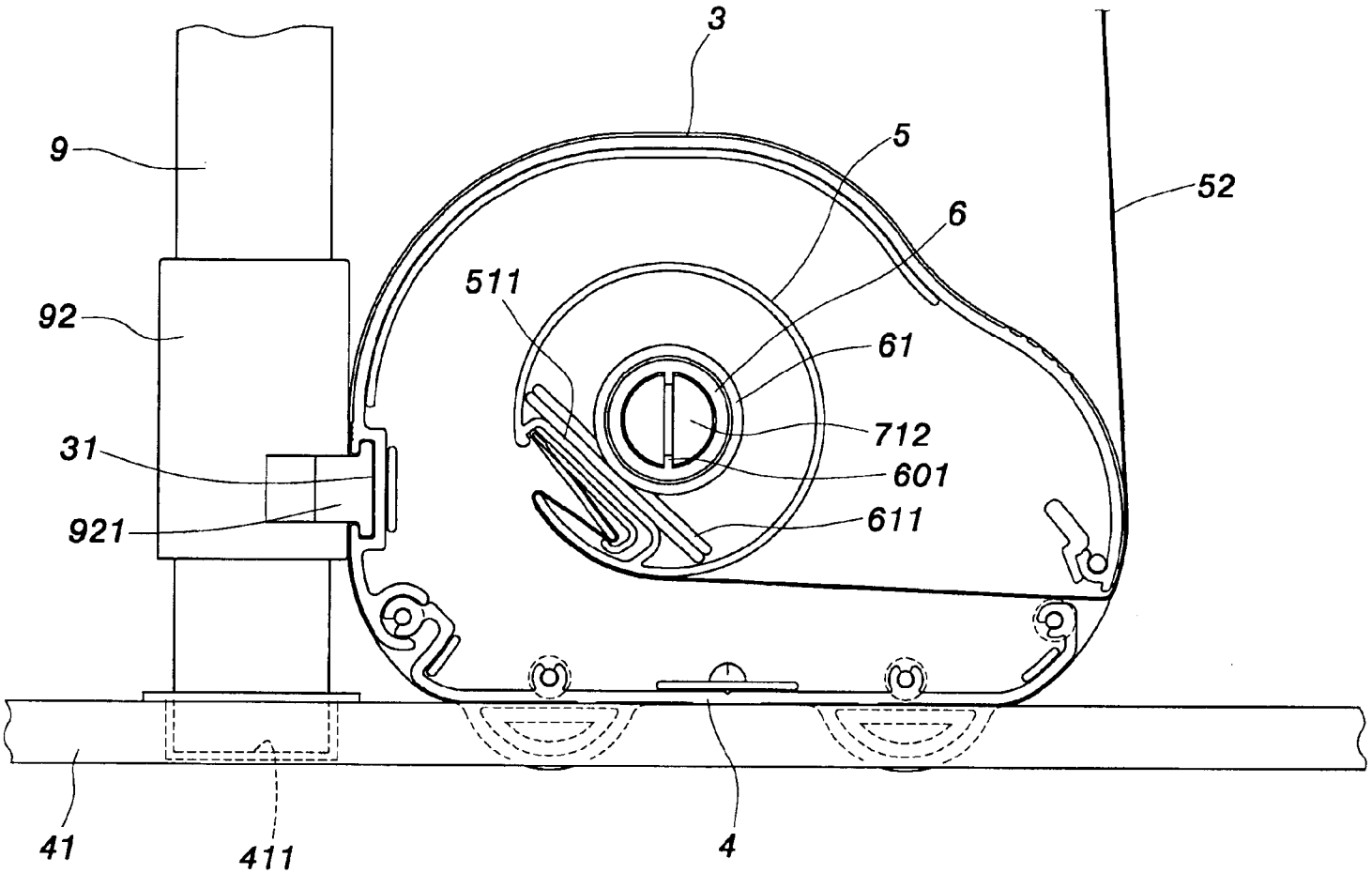
FIG. 3A is an enlarged view of a part of FIG. 3.

The reel 5 is comprised of a hollow, elongated casing 51 shaped like a split tube, having a longitudinally extended flat inside stop face 511. The tubular axle 6 has two longitudinal ribs 601 bilaterally disposed on the inside and extending to the two distal ends (see also FIG. 3A). A spring member 61 is sleeved onto the tubular axle 6 inside the casing 51, having one end terminating in a ring-like projecting portion 611, which is tangent to one end of the spring member 61 and supported on the longitudinally extended flat inside stop face 511 inside the casing 51.

Figure 4:
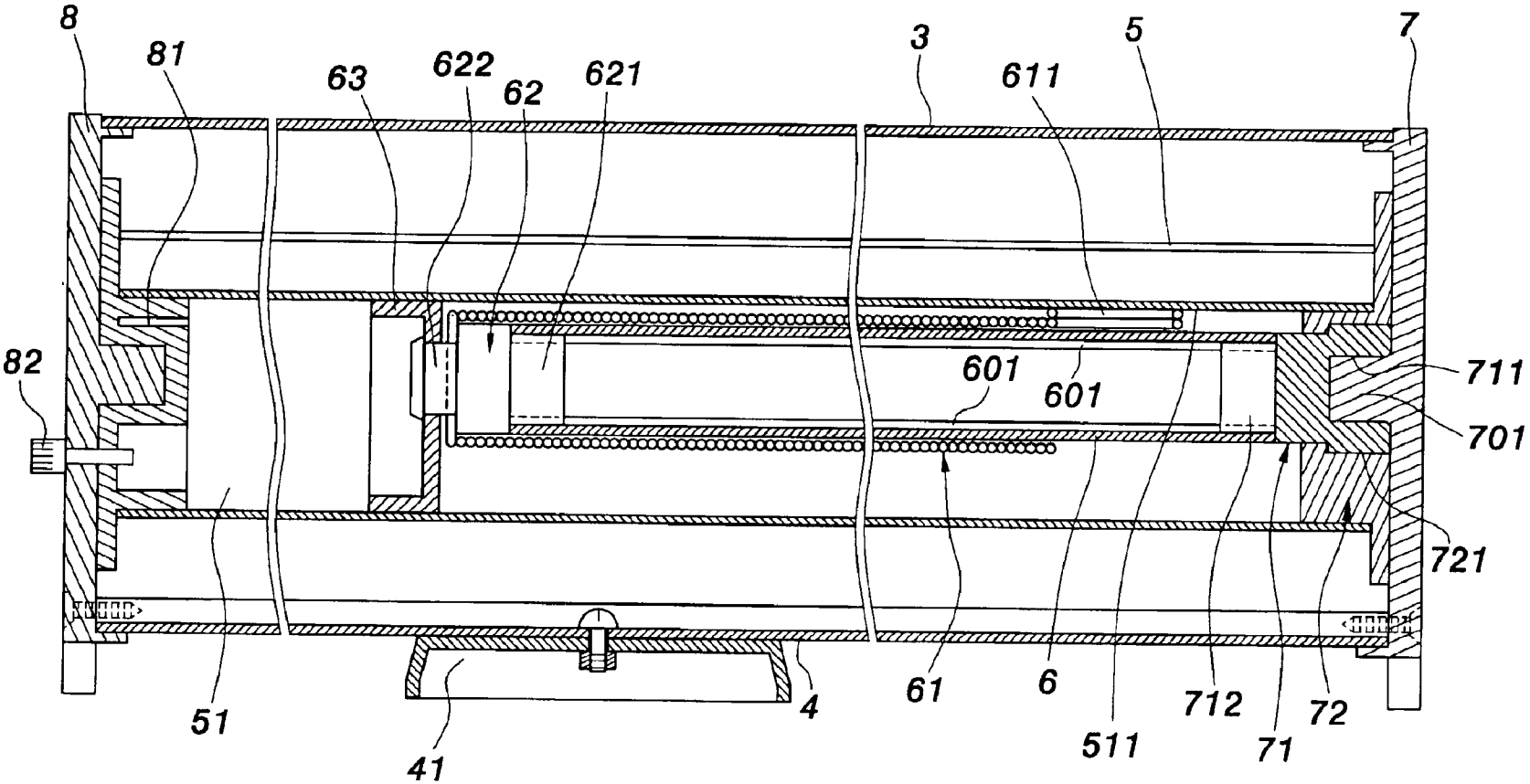
FIG. 4 is a cross-sectional view in an enlarged scale of the present invention showing the internal arrangement of the screen case.

Referring to FIGS. 1, 3A and 4 again, a connector 71 and a protective cover 72 are provided between the first end cap 7 and the tubular axle 6. The protective cover 72 has a center pivot hole 721. The connector 71 comprises a socket-like base 711 tightly capped on the non-circular peg 701 of the first end cap 7, and a split rod member 712. The split rod member 712 perpendicularly extends from the socket-like base 711, inserts through the pivot hole 721 of the protective cover 72, inserts into one end (the right end) of the tubular axle 6 and is forced into engagement with the longitudinal ribs 601 of the tubular axle 6. The protective cover 72 is press-fitted into one end (the right end) of the casing 51 and supported on the split rod member 712.

A protective cover 81 is fastened pivotally to the round peg on the inner side of the second end cap 8 and partially press-fitted into the other end (the left end) of the casing 51 of the reel 5. Thus, the first end cap 7, the connector 71 and the tubular axle 6 are prohibited from rotary motion relative to one another, and the protective covers 72 and 81 can be turned with the reel 5 about the split rod member 712 of the connector and the round peg of the second end cap 8.

A plug member 63 is fastened to the inside of the casing 51 of the reel 5. A connector 62 is connected between the plug member 63 and the tubular axle 6. The connector 62 is fastened pivotally with the plug member 63, having a cylindrical base 622 inserted into and fixedly fastened to the other end of the spring member 61 remote from the ring-like projecting portion 611 and a split rod member 621 perpendicularly extended from the cylindrical base 622, inserted into the other end (the left end) of the tubular axle 6 and forced into engagement with the longitudinal ribs 601 of the tubular axle 6. Thus, the connector 62 is prohibited from rotary motion relative to the tubular axle 6, and the left end of the spring member 61 is prohibited from rotary motion relative to the connector 62 and the tubular axle 6. However, the plug member 63 can be rotated with the reel 5 relative to the tubular axle 6 and the connector 62.

Referring to FIGS. 3, 3A and 4 again, when pulling the screen body 52, the reel 5 is rotated to let off the screen body 52. Because the ring-like projecting portion 611 of the spring member 61 is supported on the longitudinally extended flat inside stop face 511 inside the casing 51 and the other end of the spring member 61 is fixedly fastened to the connector 62, rotating the casing 51 of the reel 5 causes the spring member 61 to be twisted and store energy. When releasing the hand from the screen body 52, the spring member 61 automatically returns to its former shape, and the biasing force of the spring member 61 causes the reel 5 to rotate in the reversed direction and to roll up the screen body 52.

Further, a lock pin 82 may be inserted through a pin hole 801 in the second end cap 8 and a respective pin hole 811 in the protective cover 81 to lock the reel 5 from rotary motion. Alternatively, a flange means may be formed on one end of the reel and a lock pin may be inserted through a pin hole in the screen case and stopped at one side of the flange means to prohibit the reel from rotation.

A foot member 41 is located on the bottom side of the bottom cover shell 4, and set in a crossed manner with the screen case 300 for supporting the screen case 300 stably on a flat floor surface. The foot member 41 has a recessed coupling hole 411 in the top wall for the positioning of the screen support 900. The screen support 900 is comprised of a telescopic tube 9, a bracket 91, a slat 911, and a barrel 92. The barrel 92 has a coupling flange 921 coupled to a coupling groove 31 in the back side of the top cover shell 3 (see FIG. 3). The telescopic tube 9 is inserted through the barrel 92 and fastened to the recessed coupling hole 411 of the foot member 41. The bracket 91 is fastened to the top end of the telescopic tube 9. The slat 911 is horizontally hung on the bracket 91 and fastened to one end of the screen body 52 outside the screen case 300. Because the telescopic tube 9 is fastened to the recessed coupling hole 411 of the foot member 41, the bottom side of the foot member 41 is smooth for stable positioning on a flat floor surface (see FIG. 3).

As indicated above, the left end of the spring member 61 is fixedly fastened to the connector 62, which is fastened pivotally with the plug member 63. During installation, the spring member 61 is directly sleeved onto the tubular axle 6 for enabling the split rod member 621 to be forced into engagement with the longitudinal ribs 601 of the tubular axle 6, and then the spring member 61 is inserted with the tubular axle 6 into the casing 51 of the reel 5 to force the plug member 63 into engagement with the left end of the casing 51 of the reel 5. Further, because the tubular axle 6, the spring member 61, the connector 62, and the plug member 63 are independent members fastened to one another before installation in the reel 5, the installation procedure of the present invention is quite simple. Further, because the telescopic tube 9 of the screen support 900 is fastened to the recessed coupling hole 411 of the foot member 41, the bottom wall of the foot member 41 is smooth for stable positioning on a flat floor surface.

A prototype of screen has been constructed with the features of FIGS. 1–4. The screen functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A screen comprising:

a screen case, said screen case having a first end cap and a second end cap respectively located on two distal ends thereof;

a support member fastened to one side of said screen case;

a reel shaped like a split tube, pivotally mounted inside said screen case and rolling up a screen body, said reel having a longitudinally extended flat inside stop face;

a plug member fixedly fastened to one end of said reel;

an axle suspended inside said reel, said axle having a first end fixedly fastened to said screen case and a second end fastened pivotally with said plug member;

a spring member sleeved onto said axle inside said reel, said spring member having a first end terminating in a projecting portion stopping at the flat inside stop face of said reel and a second end fixedly connected to one end of said axle;

a first protective cover fixedly fastened to one end of said reel, said first protective cover having a center pivot hole; and a first connector coupled between said first end cap and said axle, said first connector comprising a socket-like base disposed at one end and fixedly fastened to said first end cap and a rod member disposed at an opposite end and pivotally inserted through the center pivot hole of said protective cover and fixedly fastened to the first end of said axle;

wherein when pulling said screen body out, said reel is rotated on said axle in one direction to further twist said spring member; and wherein when releasing the pulling force from said screen body, said spring member imparts a biasing force to rotate said reel on said axle in a reverse direction to roll up said screen body.

2. The screen as claimed in claim 1, wherein the projecting portion of said spring member is shaped like a ring tangent to the first end of said spring member.

3. The screen as claimed in claim 1, further comprising a lock pin insertable through said first end cap and said first protective cover.

4. The screen as claimed in claim 1, wherein said axle is a tubular member having two longitudinal ribs extending to the first and second ends, and the rod member of said first connector is a split rod member fitted into the first end of said axle and forced into engagement with the longitudinal ribs of said axle.

5. The screen as claimed in claim 1, further comprising a second connector coupled between said axle and said plug member, said second connector having a first end fastened pivotally with said plug member inside said reel and a second end fixedly fastened to the second end of said axle and the second end of said spring member.

6. The screen as claimed in claim 1, further comprising a foot member located on a bottom side of said screen case and extending across said screen case for supporting the screen on a flat floor surface.

7. The screen as claimed in claim 6, wherein said foot member has a recessed coupling hole adapted to accommodate said screen support, and said screen support comprises a barrel fixedly fastened to said screen case, a telescopic tube inserted through said barrel, said telescopic tube having a bottom end fastened to said recessed coupling hole of said foot member and a top end, a bracket located on the top end of said telescopic tube, and a slat fastened to one end of said screen body outside said screen case and hung on said bracket.

8. The screen as claimed in claim 1, wherein said screen body is an advertising medium.

9. The screen as claimed in claim 1, wherein said screen body is a projection screen body for use with a projector.

10. A screen comprising:

a screen case, said screen case having a first end cap and a second end cap respectively located on two distal ends thereof;

a support member fastened to one side of said screen case;

a reel shaped like a split tube, pivotally mounted inside said screen case and rolling up a screen body, said reel having a longitudinally extended flat inside stop face, said second end cap being fastened pivotally with one end of said reel;

a plug member fixedly fastened to one end of said reel;

an axle suspended inside said reel, said axle having a first end fixedly fastened to said screen case and a second end fastened pivotally with said plug member;

a spring member sleeved onto said axle inside said reel, said spring member having a first end terminating in a projecting portion stopping at the flat inside stop face of said reel and a second end fixedly connected to one end of said axle; and, a connector being coupled between said axle and said plug member, said connector having a first end fastened pivotally with said plug member inside said reel and a second end fixedly fastened to the second end of said axle and the second end of said spring member;

wherein when pulling said screen body out, said reel is rotated on said axle in one direction to further twist said spring member; and wherein when releasing the pulling force from said screen body, said spring member imparts a biasing force to rotate said reel on said axle in a reverse direction to roll up said screen body.

11. The screen as claimed in claim 10, wherein said axle is a tubular member having two longitudinal ribs extending to the first and second ends and the second end of said connector terminates in a split rod member fitted into the second end of said axle and forced into engagement with the longitudinal ribs of said axle.

12. The screen as claimed in claim 10, wherein said reel has a non-circular hole in one end thereof and said plug member has a non-circular part press-fitted into the non-circular hole of said reel.

13. The screen as claimed in claim 10, further comprising a protective cover coupled between said second end cap and said reel, said protective cover having a first side fastened pivotally with said second end cap and a second side press-fitted into a non-circular hole in one end of said reel.

* * * * *